US007712616B2

(12) United States Patent
Barkdoll

(10) Patent No.: US 7,712,616 B2
(45) Date of Patent: May 11, 2010

(54) DOUBLE SIDED PEG HOOK STRIPS

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 993 days.

(21) Appl. No.: 11/430,151

(22) Filed: May 8, 2006

(65) Prior Publication Data

US 2007/0278163 A1 Dec. 6, 2007

(51) Int. Cl.
*A47F 5/08* (2006.01)

(52) U.S. Cl. ..... 211/59.1

(58) Field of Classification Search ..... 211/113, 211/59.1, 57.1; 206/806; 220/4.21, 4.24
See application file for complete search history.

(56) References Cited

U.S. PATENT DOCUMENTS

| | | | | |
|---|---|---|---|---|
| 251,351 | A | 12/1881 | Ham | |
| 2,923,417 | A * | 2/1960 | Sonksen | 211/165 |
| 3,200,960 | A | 8/1965 | Banse | |
| 4,485,929 | A * | 12/1984 | Betts, Sr. | 211/74 |
| 4,815,612 | A * | 3/1989 | Leo, Sr. | 211/189 |
| 5,042,669 | A * | 8/1991 | Goldring | 211/4 |
| 5,094,352 | A * | 3/1992 | Green, Sr. et al. | 211/186 |
| 5,096,070 | A | 3/1992 | Jaynes | |
| 5,620,104 | A * | 4/1997 | Maglione | 211/59.1 |
| 5,660,286 | A | 8/1997 | Shea | |
| 5,897,709 | A * | 4/1999 | Torefors | 118/500 |
| 5,957,422 | A | 9/1999 | Shea | |
| 6,070,747 | A | 6/2000 | Shea | |
| 6,119,875 | A * | 9/2000 | Smith | 211/59.1 |
| 6,199,706 | B1 | 3/2001 | Shea | |
| 6,202,866 | B1 | 3/2001 | Shea | |
| D457,770 | S | 5/2002 | Shea | |
| D459,132 | S | 6/2002 | Shea | |
| D459,626 | S | 7/2002 | Shea | |
| 6,443,316 | B1 * | 9/2002 | Mao | 211/74 |
| D464,510 | S | 10/2002 | Shea | |
| D464,837 | S | 10/2002 | Shea | |
| D464,838 | S | 10/2002 | Shea | |
| D465,371 | S | 11/2002 | Shea | |
| D466,352 | S | 12/2002 | Shea | |
| D467,114 | S | 12/2002 | Shea | |
| D468,948 | S | 1/2003 | Shea | |
| 6,581,789 | B1 * | 6/2003 | Spanski et al. | 211/106 |
| 6,675,978 | B2 * | 1/2004 | Shea | 211/59.1 |
| 6,769,555 | B2 * | 8/2004 | Brady | 211/85.3 |
| 6,951,290 | B2 * | 10/2005 | Speed | 211/113 |
| 7,258,241 | B2 * | 8/2007 | Reid | 211/113 |
| 2003/0000904 | A1 * | 1/2003 | Lung et al. | 211/163 |
| 2006/0091092 | A1 * | 5/2006 | Vosbikian | 211/87.01 |
| 2006/0207955 | A1 * | 9/2006 | Ouyang et al. | 211/103 |
| 2007/0241070 | A1 * | 10/2007 | Maheu et al. | 211/59.1 |

* cited by examiner

*Primary Examiner*—Jennifer E. Novosad
(74) *Attorney, Agent, or Firm*—Reinhart Boerner Van Deuren P.C.

(57) ABSTRACT

A peg hook support structure is provided. The peg hook support structure includes two mating bodies that are preferably substantially similar. A vertical support supports the two mated bodies in a vertical orientation. The support may vertically support may support the mated bodies from the bottom in an upright orientation or from the top in a hanging orientation. The mated bodies include a plurality of peg hook mounts for securing peg hooks to the mated bodies. When mounted to the mated bodies, the peg hooks project laterally outward from the mated bodies such that merchandise may be supported thereto. The bodies may be configured such that they are identical.

15 Claims, 7 Drawing Sheets

DOUBLE SIDED PEG HOOK STRIPS

FIELD OF THE INVENTION

This invention generally relates to retail merchandise display assemblies, and more particularly, to strip retail merchandise display assemblies having display hooks for supporting retail merchandise.

BACKGROUND OF THE INVENTION

Retail merchandise display is very important to the retail industry. Products need to be displayed in a visually appealing manner and the display device must be able to hold an adequate volume of product such that the display does not become quickly emptied. Typical means of displaying retail merchandise for sale includes shelving or display hooks connected to a vertical support. However, in many instances, retail establishments will attach additional strip display devices to a shelving unit or at an end of aisles and stock these devices with impulse goods or other point-of-purchase product such as, for example, small toys or candy. These devices will typically hang from a support hook or device that is cantilevered from the shelf or the end of the aisle.

Many strip merchandising devices are known in the art. Among the many strip merchandising devices include elongated plastic support strips that include a plurality of axially spaced attachment tongues that extend outward from the strips. The tongues are typically integrally formed with the plastic strips and are merely cut out of the strip material. However, the tongues may be subsequently attached to the elongated support strips. Such plastic support strip devices are illustrated in U.S. Pat. No. 5,096,070 to Jaynes. These devices are cheap to manufacture but are limited to a relatively small volume of light weight product because the tongues are typically short and can be flimsy.

U.S. Pat. No. 5,957,422 to Shea attempted to provide a larger volume strip-type merchandise display. For example, the Shea patent discloses the use of a more rigid corrugated elongated strip having a plurality of holes for securing rigid peg hooks to the elongated strip. Unfortunately, when a single strip according to the teachings of Shea is used, the peg hook mounts are visible on the opposite side of the strip as the support arm of the peg hooks. If two strips are used in a back-to-back configuration the peg hook mounts are visible from the side of the strips. Additionally, in the back-to-back configuration, the positioning of the peg hook mounts between the two back-to-back strips causes interference between the strips causing them to separate from one another further degrading the visual appearance of the device.

There is therefore a need in the art for an improved strip-type display device that is strong enough to support peg hooks for large quantities of product while remaining visually appealing. Such a device would preferably be modular, practical and reliable.

BRIEF SUMMARY OF THE INVENTION

In one aspect, the present invention provides an improved strip-type peg hook product display apparatus having increased strength and visual appeal over the prior art. The peg hook product display includes a support for vertically supported peg hook support housing. The peg hook support housing includes first and second housing bodies joined together. The peg hook product display apparatus further includes at least one peg hook mounted to the peg hook support housing. The at least one peg hook projects laterally outward from the peg hook support housing.

In another aspect, the invention provides a peg hook support apparatus for supporting peg hooks having first and second substantially similar housing bodies. The first and second housing bodies have a mated state in which the first body mates with the second body forming a cavity between the two bodies. At least one alignment structure formed into at least one of the housing bodies aligns the first and second housing bodies in a predetermined orientation relative to each other in the mated state. At least one coupling secures the first and second housing bodies together in the mated state. Furthermore, each of the housing bodies defines at least one peg hook support for supporting a peg hook. The peg hook support comprises at least one hole adapted to receive a peg hook mount.

In yet another aspect, the invention provides a peg hook support body for supporting a plurality of peg hooks. The support body comprises a pair of substantially similar first and second mating support bodies. Each support body is formed of molded plastic and includes a peg hook mounting panel defining a plurality of holes sized and configured to receive and support a peg hook. First and second sidewalls extend inwardly from the peg hook mounting panel. The sidewalls in combination with the peg hook mounting panel form an interior channel. Each support body includes alignment structure arranged and configured to align the mated support bodies with one another. Each support body further includes at least one snap structure integrally formed into the housing body and projecting inwardly into the interior channel. The at least one snap structure having means for coupling the housing bodies together.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
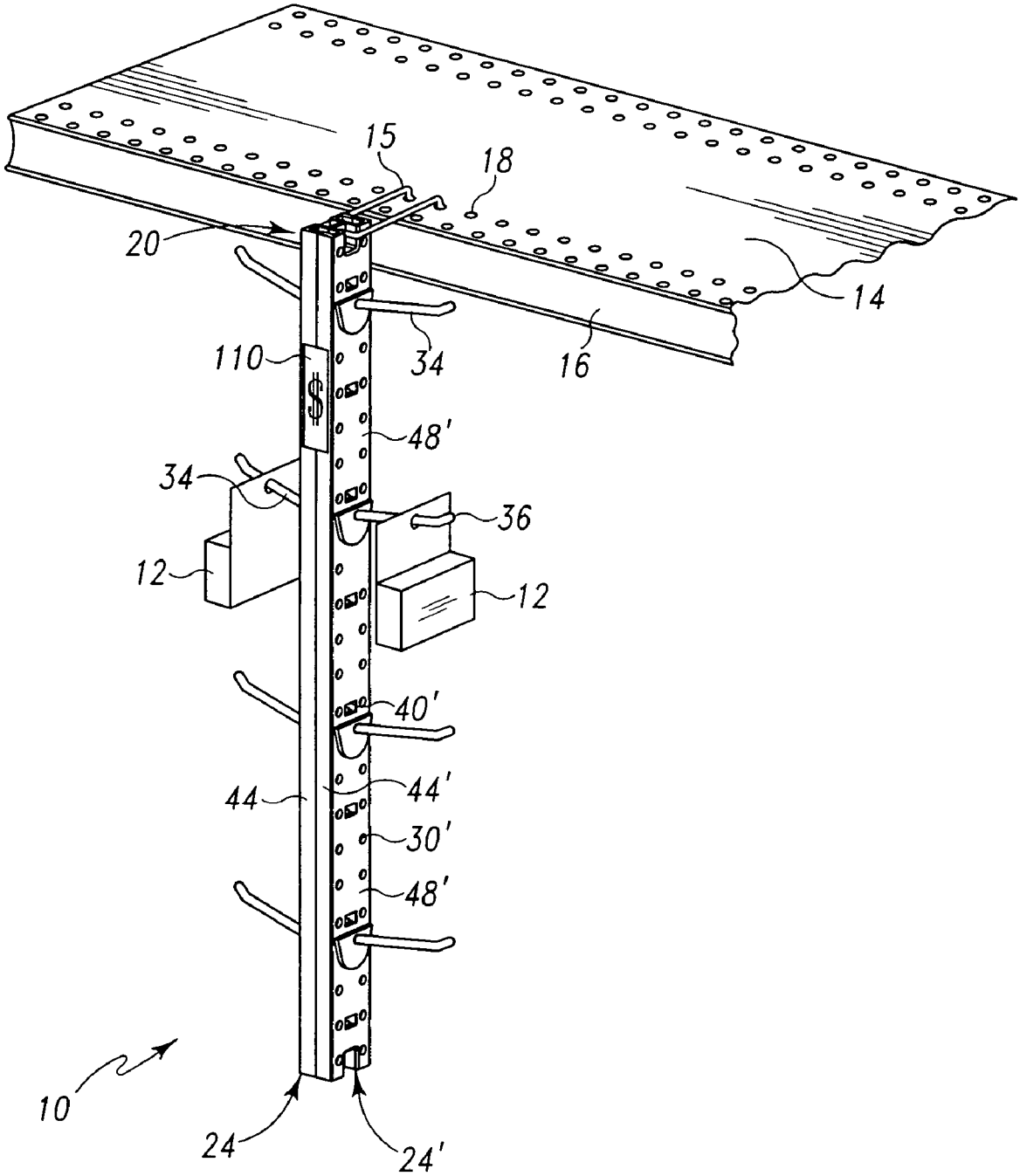
FIG. 1 is a partial perspective view of a product display shelf having a peg hook support strip in accordance with the teachings of the present invention mounted thereto.

Referring now to the figures, FIG. 1 illustrates a peg hook support strip 10 for supporting merchandise 12 connected to and supported by a horizontal display shelf 14. The support strip 10 is connected to the display shelf 14 by a wire hanger 15 connected to the display shelf 14 in a cantilevered condition. The display shelf 14 has a front edge 16 and several rows of transversely spaced and vertically extending holes 18. The wire hanger 15 is generally U-shaped having a pair of spaced apart arms connected at one end and terminating in distal ends 19 (see FIG. 2) to form the U-shape. The distal ends 19 attach the wire hanger 15 to the display shelf 14 by inserting into the holes 18 in the display shelf 14. The wire hanger 15 connects to the support strip 10 by passing through a hole in the support strip 10 proximate an upper end 20 such that the support strip 10 freely hangs from the wire hanger 15. The display shelf 14 is typically secured to a vertical support structure (not shown) and is particularly suited to display large quantities of retail merchandise. The invention is illustrated with reference to a horizontal shelf but may be mounted to other shelving or support structure such as directly to the vertical supports for the shelving, pegboards, display bins and the like.

The support strip 10 includes two elongated support bodies 24, 24' attached together in a back-to-back orientation. In a preferred embodiment, the two support bodies 24, 24' are formed from molded plastic and are substantially identical to one another (as used herein, substantially identical or substantially similar includes identical). By having substantially identical support bodies, advantageously, the same mold or mold design may be used to form each of the support bodies 24, 24'. Also, inventory, supply, tooling and assembly issues are simplified and costs are reduced. Each of the support bodies 24, 24' includes a plurality of laterally and vertically spaced apart peg hook mounting holes 30, 30' for receipt of peg hook mounts 32 (see also FIGS. 4 and 5) to secure peg hooks 34 to the support bodies 24, 24'. The peg hooks 34 extend outward from the support strip 10 and support the merchandise 12 carried by the support strip 10. As illustrated, the peg hooks include 34 include laterally extending support arms terminating in up-turned distal ends 36 to prevent merchandise 12 from inadvertently and easily falling off of the peg hook 34. The peg hooks 34 may take many forms and may include multiple arms. Furthermore, the peg hooks 34 may be formed from plastic or metal.

Figure 2:
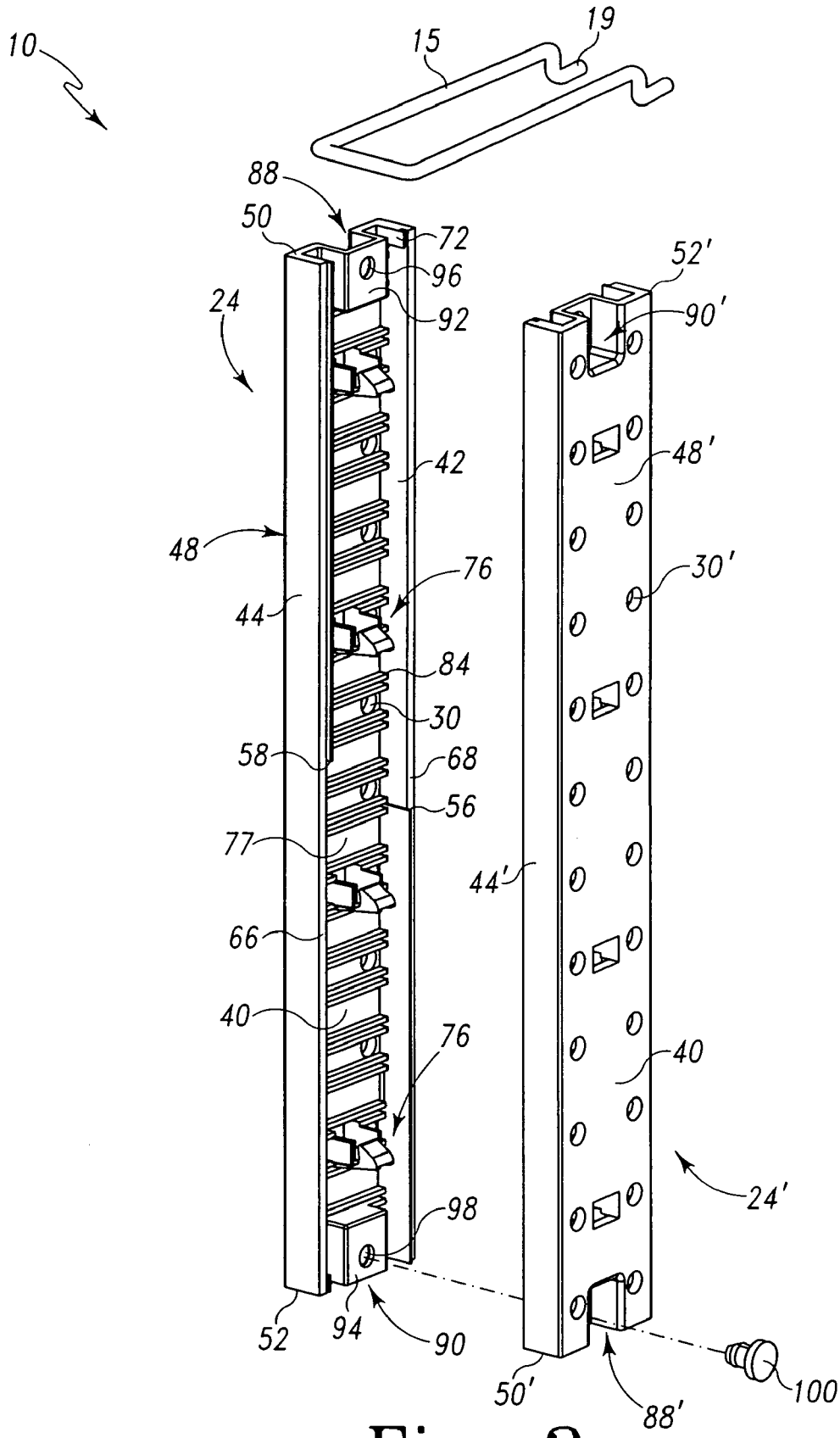
FIG. 2 is an exploded view of the peg hook support strip of FIG. 1.

As more fully illustrated in FIG. 2, the support strip 10 includes two separate, yet substantially identical, support bodies 24, 24', which may be structurally the same. In a preferred embodiment, the support bodies 24, 24' are substantially identical such that only a single type of support body need be molded. For ease of understanding, the present invention will be first explained with reference to a single support body 24.

The support body 24 is an elongated body that generally includes a front panel 40 and first and second sidewalls 42, 44. The front panel 40 includes the peg hook mounting holes 30 for securing peg hooks. The front surface 48 of the front panel 40 is generally planar and smooth.

The first and second sidewalls 42, 44 are laterally spaced apart and extend rearward from the front panel 40 forming a channel therebetween. The sidewalls 42, 44 preferably extend the entire length of the support body 24 from a first end 50 to a second end 52. The sidewalls 42, 44 increase the rigidity of the support body 24. In the illustrated embodiment, the first and second sidewalls 42, 44 include alignment flanges 56, 58, respectively, that extend only a portion of the length of the respective sidewall 42, 44. The alignment flanges 56, 58 begin at an end 50, 52 of the support body 24 and extend toward the opposite end 52, 50 of the support body 24, but in the illustrated embodiment, the alignment flanges 56, 58 do not extend axially beyond the center of the respective sidewalls 42, 44. In other words, the alignment flanges 56, 58 extend no more than half the length of the side walls 42, 44, respectively. This prevents the alignment flanges 56, 58 from interfering with the alignment flanges 56', 58' of the second support body 24' when two bodies 24, 24' are mated together in the back-to-back orientation.

Figure 3:
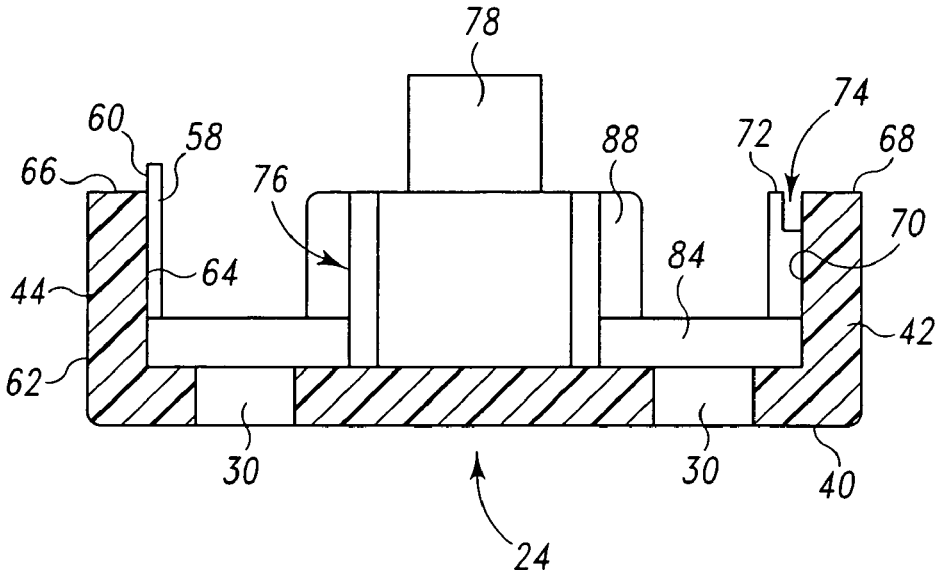
FIG. 3 is a cross-sectional illustration of a support body of the peg hook support strip of FIG. 2.

With reference to FIG. 3, the outer flange surface 60 of the alignment flange 58 of sidewall 44 is spaced laterally inward from the outer wall surface 62 of the sidewall 44 forming a stepped profile. Preferably, the outer flange surface 60 of the alignment flange 58 substantially aligns with an inner wall surface 64 of the sidewall 44. Furthermore, the alignment flange 58 extends rearward, relative to the front panel 40, beyond an abutment surface 66 of the sidewall 44. As further illustrated in FIG. 4, the alignment flange 58 of the sidewall 44 of the first support body 24 and the alignment flange 56' of a sidewall 42' of the second support body 24' function to laterally align and position the first support body 24 relative to the second support body 24' when the first and second support bodies 24, 24' are mated. In the mated position, the first and second support bodies 24, 24' align back-to-back and head-to-toe. The illustrated embodiment must be mated head-to-toe to prevent the alignment flanges of the first and second support bodies 24, 24' from interfering with each other. In the mated condition, the abutment surfaces 66, 68 of the sidewalls 42, 44 of the first support body 24 abut with the abutment surfaces 66', 68' of sidewalls 42', 44' of the second support body 24', respectively.

In the mated condition, the alignment flanges 56, 58 of the first support body 24 between the sidewalls 42', 44' of the second support body 24'. Similarly, the alignment flanges of the second support body 24' are interposed between the sidewalls 42, 44 of the first support body 24. This configuration prevents lateral movement of the support bodies 24, 24' relative to one another.

In an embodiment, the alignment flange 58 may be canted laterally outward or include a rib to provide a snug fit insertion and engagement of the alignment flange 58 with an inner surface 64' of the sidewall 44' of the second support body 24'. Preferably, the alignment flange 58 is canted no more than 10 degrees. Specifically, the outer surface 60 of the alignment flange 58 may extend at an angle laterally outward over the top abutment surface 66 of the sidewall 44. This configuration assists in securing the first body 24 to the second body 24'. The inner surface 64' of sidewall 44' may include a groove or indented region for receipt or engagement of such an alignment flange 58.

Figure 4:
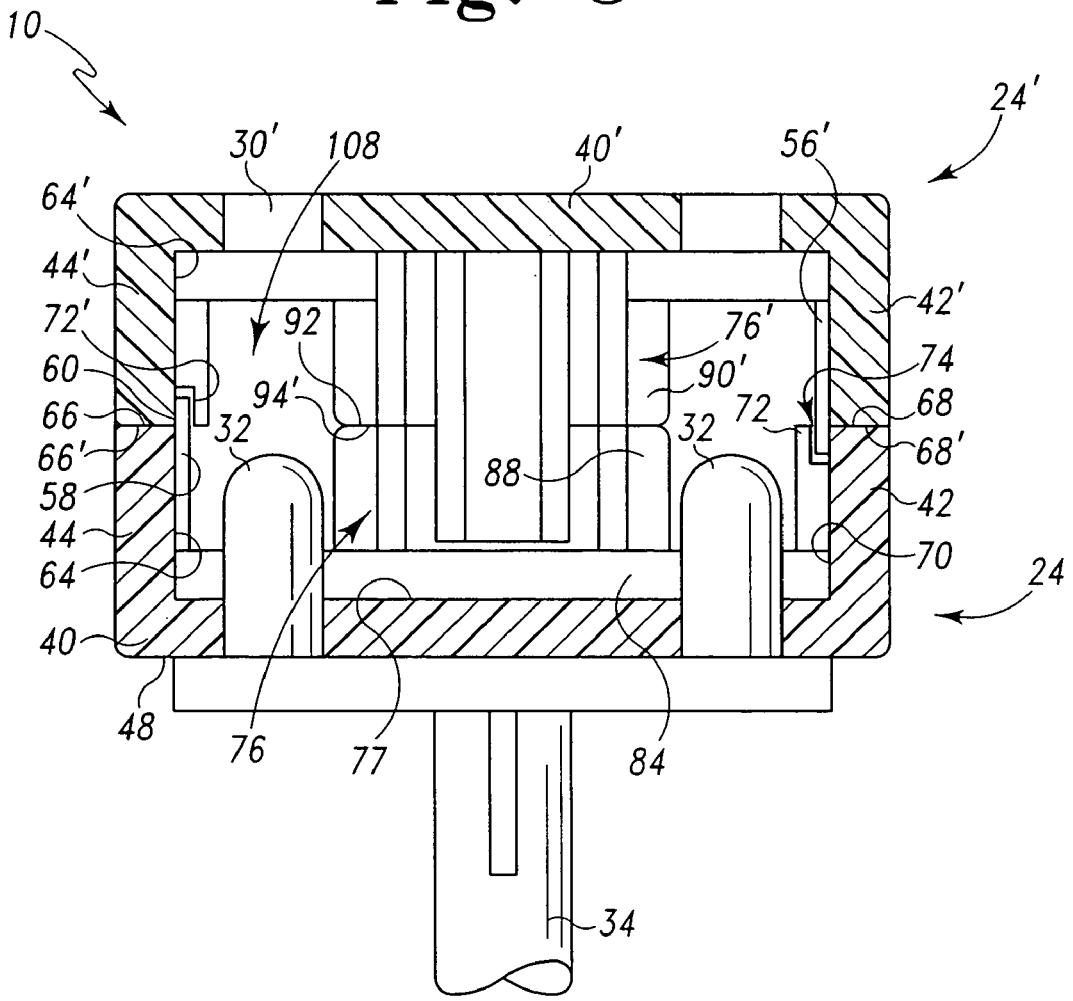
FIG. 4 is a cross-sectional illustration of a pair of support bodies mated in a back-to-back position and forming a peg hook support strip.

As illustrated in FIGS. 3 and 4, the sidewalls 42 may include an alignment flange securing member 72 that forms a channel 74 between itself and the sidewall 42. The alignment flange securing member 72 includes a portion that is spaced laterally inward from the sidewall 42 to provide the channel 74 therebetween. The channel 74 receives a portion of the alignment flange 56' when two bodies are mated together. The alignment flange securing member 72 may have a tapered end to promote insertion of the other bodies alignment flange 56'.

Figure 8:
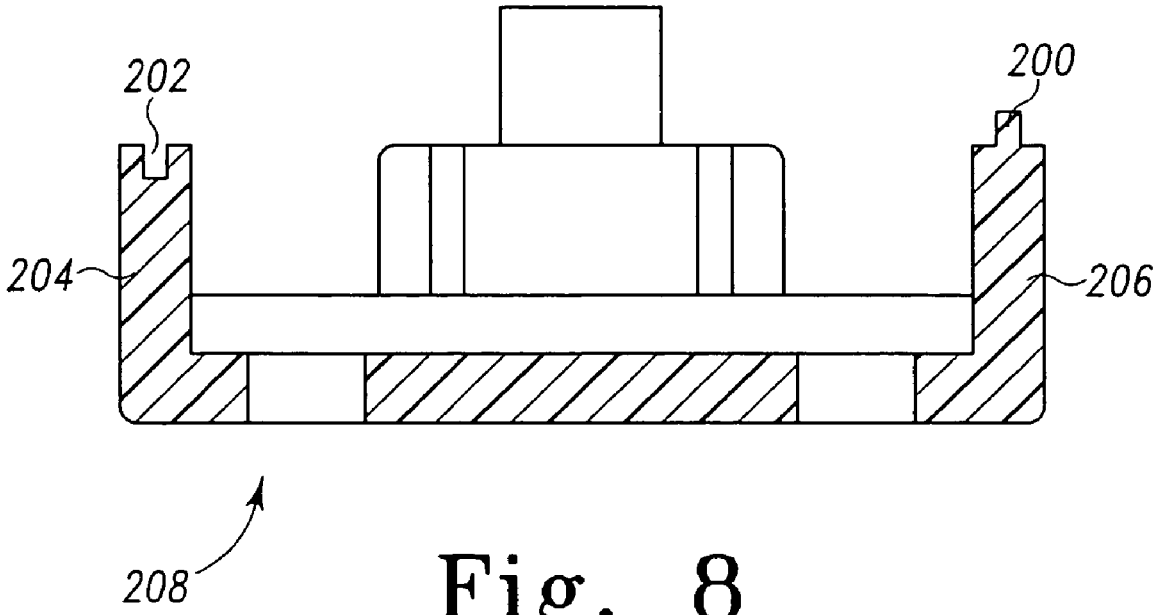
FIG. 8 is a cross-sectional illustration of another embodiment of a support body in accordance with the teachings of the present invention.

In an embodiment, the alignment flanges 56, 58 may be replaced by a plurality of pegs 200 and holes 202 as illustrated in FIG. 8. When two support bodies of this embodiment are mated, the pegs of one support body align with holes of another support body to prevent misalignment of the two support bodies. The pegs 200 and corresponding holes 202 could be any shape. Furthermore, the pegs 200 and holes 202 need not be integral with the walls 204, 206 of the support body 208, but could be positioned anywhere within the support body 208.

Referring to FIG. 2, a plurality of clips 76 extend rearward from an inner side 77 of the front panel 40 of the support body 24. The clips 76 are resilient in nature such that they act as corresponding snaps when the housing bodies are manually pressed together to hold or help hold the bodies together. With reference to FIGS. 3-6, clips 76, 76' secure the first support body 24 to the second support body 24' in the mated position. The clips 76 are interposed laterally between the first and second sidewalls 42, 44. The clips 76 include a top guide surface 78 and a bottom catch surface 80. The top guide surface 78 assists engagement of the clip 76 with another clip 76' of the second support body 24' (see FIG. 6). The top guide surface 78 interacts with and abuts with a top guide surface 78' of a corresponding clip 76' while the first and second support bodies 24, 24' are mated, particularly if the two support bodies 24, 24' are mated by being pressed together in a direction normal to the front panels 40, 40'. The angled configuration of the guide surface 78 acts as a wedge and helps resiliently bias the corresponding clip 76' during engagement. The bottom catch surface 80 engages the bottom catch surface 80' of the corresponding clip 76' to prevent the first and second support bodies 24, 24' from separating.

Figure 7:
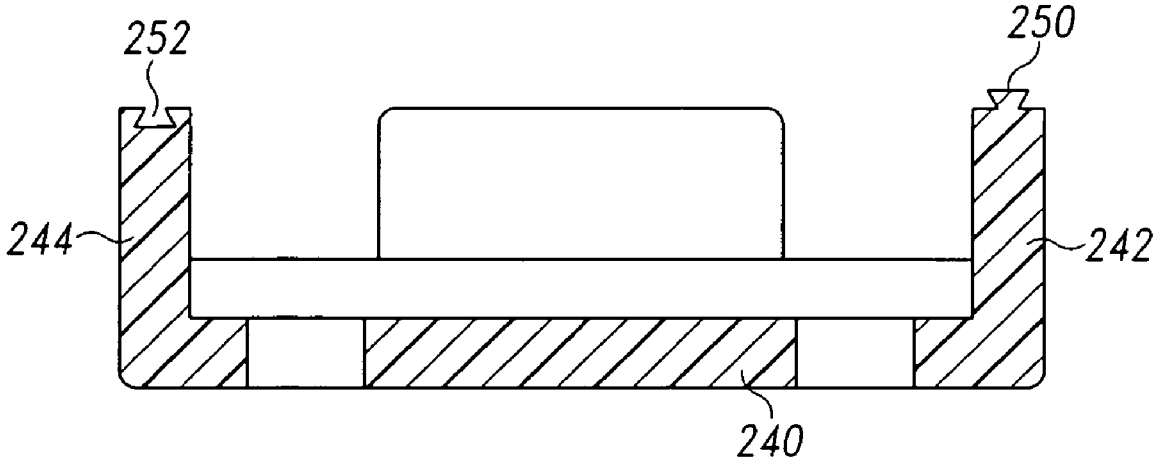
FIG. 7 is a cross-sectional illustration of another embodiment of a support body in accordance with the teachings of the present invention.

In an embodiment, the alignment flanges 56, 58 and clips 76 may be replaced by a tongue and groove system, as illustrated in FIG. 7. The tongue and groove system may function to both align a support body 224 relative to a second substantially similar support body as well as secure the two bodies together. The first sidewall 242 includes a tongue 250 extending rearward relative to a front panel 240 and the second sidewall 244 includes a corresponding groove 252. The tongue and groove 250, 252 extend the length of the first and second sidewalls 242, 244, respectively. In this embodiment, first and second support bodies slidingly engage one another. Particularly, with the two bodies positioned end-to-end and back-to-back, the corresponding tongues and grooves of the two bodies engage one another as the two bodies are slid together. In this embodiment, the tongues and grooves perform the lateral alignment function as well as secure the two bodies together. Thus, separate clips are not required in this system, although snaps may be provided to prevent sliding movement once assembled.

Figure 5:
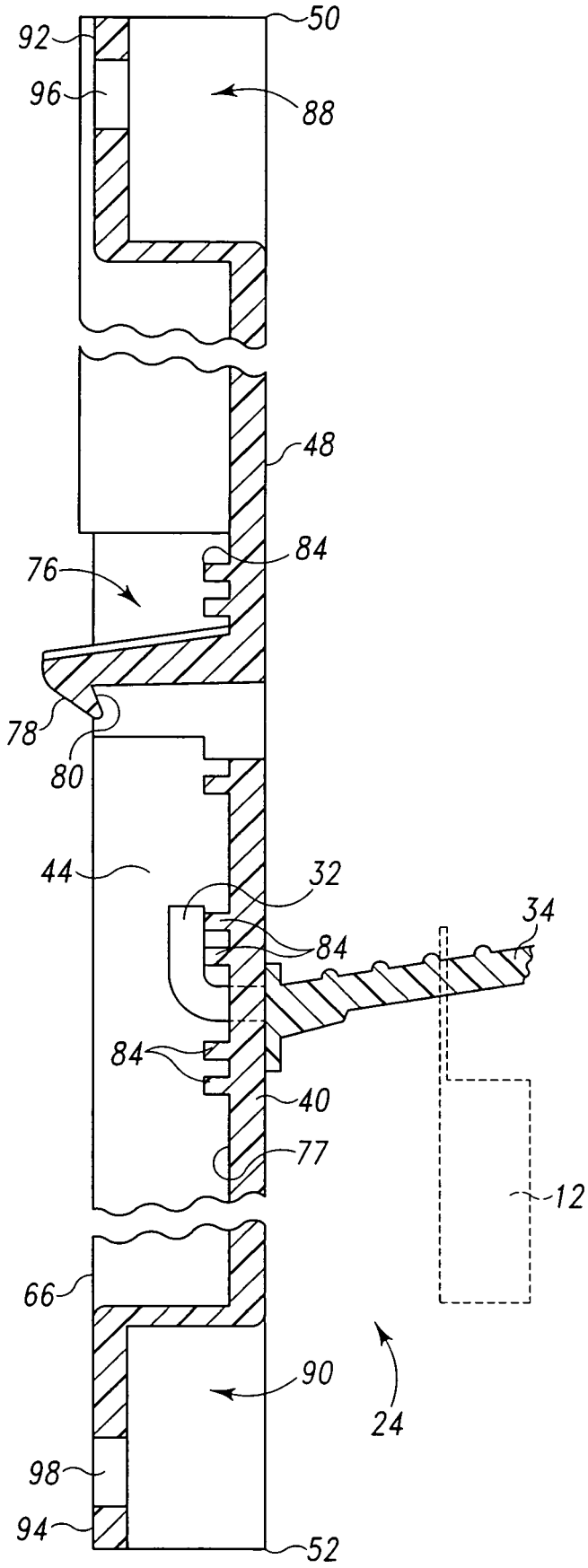
FIG. 5 is a further cross-sectional illustration of the support body of FIG. 3.

With reference to FIGS. 2, 4 and 5, a plurality of ribs 84 extend rearward from the inner side 77 of the front panel 40. The ribs 84 are positioned proximate the holes 30 in the front panel 40 and extend laterally from the first sidewall 42 to the second sidewall 44. The ribs 84 function as supports for peg hook mounts 32 when the peg hook 34 is mounted to the support body 24. The peg hook mounts 32 press against the ribs 84 and the ribs distribute the force of the peg hook mounts 32 to prevent the peg hooks 34 from locally bending or damaging the front panel 40 proximate the holes 30.

Figure 6:
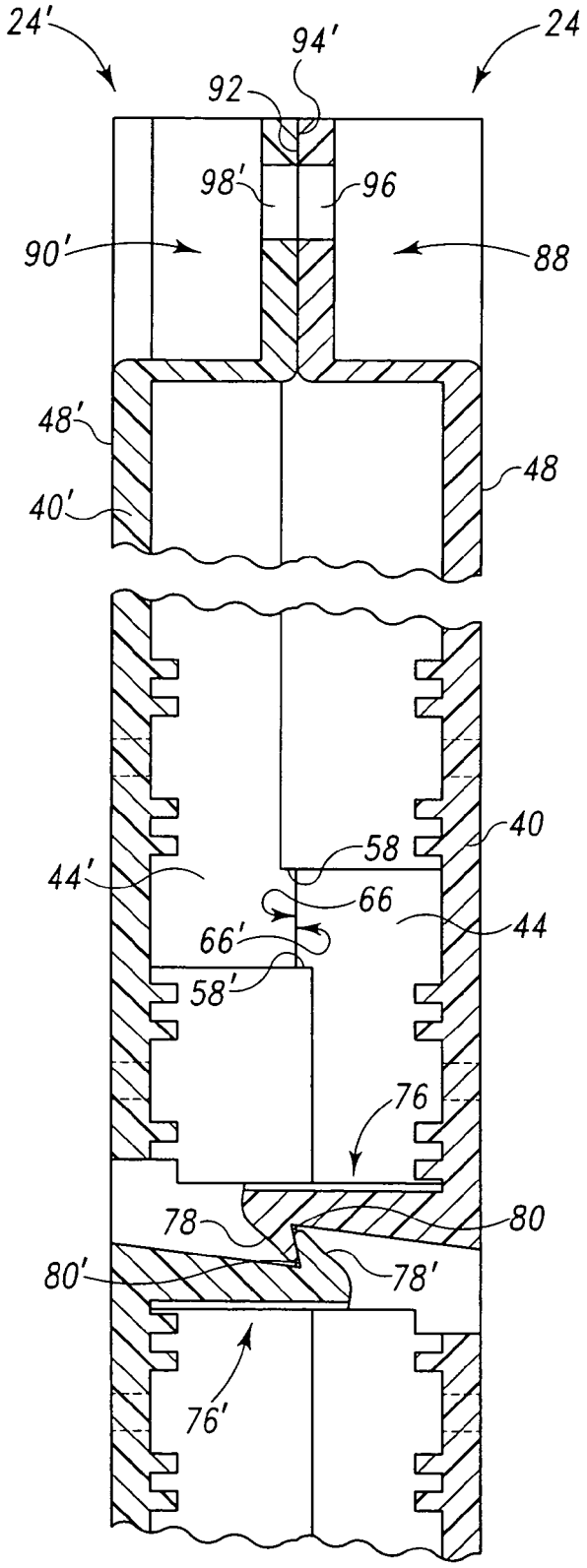
FIG. 6 is a further cross-sectional illustration of the pair of mated support bodies of FIG. 4 forming a peg hook support strip.

The front panel 40 includes first and second recessed regions 88, 90 proximate the first and second ends 50, 52, respectively. The recessed regions 88, 90 are positioned rearward from rest of the front panel 40. The recessed regions 88, 90 include abutment surfaces 92, 94 that include holes 96, 98 respectively. The holes 96, 98 are sized for receipt of the wire hanger 15 to support the support strip 10, as explained and illustrated in FIG. 1. With reference to FIGS. 4-6, the first recessed region 88 of the first support body 24 interacts with a corresponding second recessed region 90' of the second support body 24' such that abutment surface 92 and corresponding hole 96 align with abutment surface 94' and corresponding hole 98'. With the holes 96, 98' aligned, the wire hanger 15 may be inserted therethrough for supporting the support strip 10 (see FIG. 1). Furthermore, as the holes 98, 96' at the opposite end of the first and second support bodies 24, 24', respectively, align, a pushpin 100 may be inserted into the bottom end of the support strip 10 to further secure the first and second support bodies 24, 24' together (see FIG. 2). Other securing or coupling means may also or alternatively be used, including a fastener, a clip, a snap, a peg, a catch, or other connector.

As illustrated in FIG. 4, the first and second support bodies 24, 24' form a cavity 108 when the two support bodies 24, 24' mate. The cavity 108 beneficially hides the peg hook mounts 32. As can be seen in FIG. 1, with the two support bodies 24, 24' in a mated position, the outer surfaces of mated sidewalls 44, 44' provide a substantially smooth and planar continuous surface. A label 110 or other indicia may be adhesively secured to the outer surface of the sidewalls 44, 44' for displaying pricing information or other pertinent product information.

Figure 9:
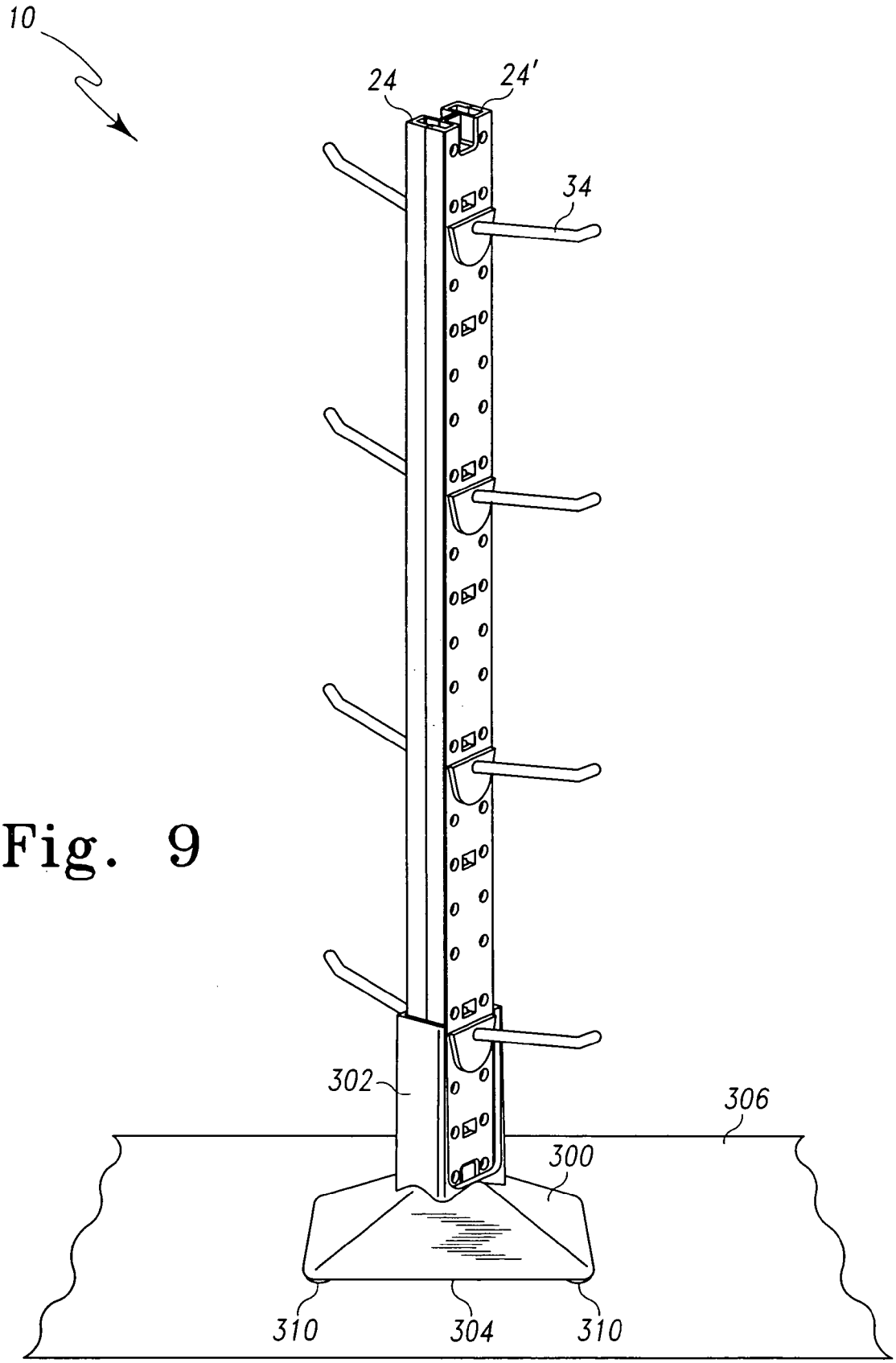
FIG. 9 is a perspective view of the peg hook support strip of FIG. 1 supported by a base rather than a hanger mounted to a shelf in a cantilevered condition.

As explained previously, the support strip 10 may be hung in a cantilevered position from a shelf 14 or other support structure. However, it is an aspect of the present invention that the support bodies 24, 24' provide sufficient rigidity when secured together that the support strip 10 is sufficiently rigid to be supported at the bottom and extend vertically upwards from an appropriate support. As is illustrated in FIG. 9, the support strip 10 is inserted into a pocket 302 of a support base 300. The support base 300 includes a bottom 304 for resting on a substantially flat surface 306. The pocket 302 extends vertically upward from the bottom 304. The pocket 302 is sized for receipt of the support strip 10 without significant slop or play. Preferably, the support strip 10 is snuggly received in the pocket 302 of the support base 300 and the support strip 10 extends vertically upward in a direction substantially normal to a plane that includes the bottom 304 of the support base 300.

In an embodiment, the support base 300 includes a plurality of pads 310 attached to the bottom 304 of the base 300. The pads 310 may include an adhesive on the free side to secure the support base 300 to the supporting surface 306 such as a table, shelf, floor, or other surface on which the support base 300 may rest. In an another embodiment, the pads 310 may be foam or rubber pads without any adhesive to prevent the support base 300 from slipping on or scratching the surface 306 on which it rests, but such pads would not secure the base 300 to the surface. In a further embodiment, the bottom 304 of the base 300 may not include any pads such that the base 300 directly sits on the surface 300.

Preferably, the individual support bodies 24, 24' have a longitudinal length between about 6 inches and four feet and more preferably between about 12 inches and about 36 inches. The sidewalls 42, 44 are preferably sized and extend rearward from the front panel such that when two support bodies 24, 24' are mated, the front panel 40 of the first support body 24 is spaced between about ½ inches and about 3 inches, and more preferably between about 1 inches and about 2 inches from the front panel 40' of the second support body 24'. The width of the support body 24 is preferably between about ¾ inches and 2 inches. However, the length, widths, and depths of the support strips are not limited to these ranges and can be substantially any value for a given application.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A peg hook retail display apparatus for displaying retail merchandise, comprising:

a support;

a peg hook support housing, the peg hook support housing supported by the support and extending vertically therefrom, the peg hook support housing including first and second separate housing bodies joined together; and at least one peg hook mounted on the peg hook support housing, the at least one peg hook projecting laterally outward from the peg hook support housing, wherein each of the first and second housing bodies include:

(a) a peg hook mounting panel defining a plurality of holes sized and configured to receive peg hook mounts to mount the peg hook;

(b) a pair of sidewalls extending rearwardly from the peg hook mounting panel, the sidewalls in combination with the peg hook mounting panel forming an interior channel;

(c) alignment structure, the alignment structure arranged and configured to align the housing body with a mated housing body; and (d) at least one clip structure integrally formed into the housing body and projecting inwardly into the interior channel, the at least one clip structure having means for coupling the housing bodies together.

2. The peg hook retail display apparatus of claim 1, wherein the support is a hanger having a hanger mount and at least one support arm, the mount adapted to be mounted to a retail display support structure.

3. The peg hook retail display apparatus of claim 2, wherein each of the housing bodies includes a hole proximate each end of the housing bodies, the holes sized to receive the hanger.

4. The peg hook retail display apparatus of claim 1, wherein the support is a base structure having a pocket configured to receive an end of the peg hook support housing, the peg hook support structure extending vertically upward from the base structure.

5. The peg hook retail display apparatus of claim 1, wherein the peg hook support housing is formed from a plastic material.

6. The peg hook retail display apparatus of claim 1, wherein the alignment structure includes a plurality of pegs and a corresponding plurality of peg receiving cavities.

7. The peg hook retail display apparatus of claim 1, wherein each of the first and second housing bodies include at least one tongue and at least one groove to mate the first and second housing bodies together.

8. The peg hook retail display apparatus of claim 1, wherein the alignment structure includes at least one flange positioned proximate each sidewall and extending rearward beyond the proximate sidewall.

9. A peg hook support apparatus for supporting peg hooks for displaying retail merchandise, comprising:

first and second substantially similar housing bodies formed from a plastic material, the first and second housing bodies having a mated state in which the first body mates with the second body forming a cavity therebetween, at least one alignment structure formed into at least one of the housing bodies aligning the first and second housing bodies in a predetermined orientation relative to each other in the mated state, at least one coupling securing the first and second housing bodies together in the mated state, each of the housing bodies defining at least one peg hook support for supporting a peg hook, the peg hook support comprising at least one hole adapted to receive a peg hook mount of the peg hook; and wherein the at least one coupling includes at least one resilient clip extending rearward from each housing body, the clip having a tapered guide surface and a catch portion for engaging a corresponding catch portion of another clip of another housing body.

10. The peg hook support apparatus of claim 9, wherein the predetermined orientation is back-to-back and head-to-toe.

11. The peg hook support apparatus of claim 9, wherein the alignment structure includes at least one flange that mates with the other housing body in the mated state.

12. The peg hook support apparatus of claim 9, wherein the at least one alignment structure includes a plurality of pegs and corresponding peg receiving cavities.

13. The peg hook support apparatus of claim 9, wherein the at least one alignment structure includes at least one tongue and at least one groove integrally formed in each of the housing bodies.

14. The peg hook support apparatus of claim 9, wherein when a peg hook is mounted to the peg hook support apparatus, the peg hook mounts are substantially positioned within the cavity.

15. The peg hook support apparatus of claim 9 further comprising:

a support, the first and second substantially similar housing bodies extending vertically therefrom; and at least one peg hook mounted on the peg hook support housing, the at least one peg hook projecting laterally outward from the peg hook support housing; and wherein each of the first and second housing bodies include first and second sidewalls extending inwardly, the first sidewall of the first housing body engaging the second sidewall of the second housing body and the second sidewall of the first housing body engaging the first sidewall of the second housing body.

* * * * *